US010422524B2

(12) United States Patent
Bzowski

(10) Patent No.: US 10,422,524 B2
(45) Date of Patent: Sep. 24, 2019

(54) REMOTE FLAME SENSING SYSTEM

(71) Applicant: Ori Adam Bzowski, Markham (CA)

(72) Inventor: Ori Adam Bzowski, Markham (CA)

( * ) Notice: Subject to any disclaimer, the term of this patent is extended or adjusted under 35 U.S.C. 154(b) by 110 days.

(21) Appl. No.: 15/474,491

(22) Filed: Mar. 30, 2017

(65) Prior Publication Data

US 2018/0283686 A1 Oct. 4, 2018

(51) Int. Cl.

| | |
|---|---|
| ***F23N 5/18*** | (2006.01) |
| ***F23D 14/10*** | (2006.01) |
| ***F23N 5/12*** | (2006.01) |
| ***F23D 14/58*** | (2006.01) |

(52) U.S. Cl.

CPC ..... *F23D 14/10* (2013.01); *F23D 14/586* (2013.01); *F23N 5/12* (2013.01); *F23N 2029/12* (2013.01)

(58) Field of Classification Search

CPC ..... F23N 5/12; F23N 5/184; F23N 2029/12

USPC ..... 431/25

See application file for complete search history.

(56) References Cited

U.S. PATENT DOCUMENTS

| | | | | |
|---|---|---|---|---|
| 4,405,299 A * | 9/1983 | Serber | F23Q 7/10 431/25 |
| 5,336,851 A * | 8/1994 | Sawada | H01B 3/105 174/110 A |
| 2016/0169823 A1* | 6/2016 | Freymiller | F23N 5/12 324/649 |

FOREIGN PATENT DOCUMENTS

| | | | | |
|---|---|---|---|---|
| CN | 201449759 U * | 5/2010 | H01B 3/04 |
| JP | H0525152 U * | 4/1993 | F23N 5/12 |

* cited by examiner

*Primary Examiner* — Avinash A Savani

(74) *Attorney, Agent, or Firm* — Nasser Ashgriz; UIPatent Inc.

(57) ABSTRACT

The present invention is a burner flame detector to detect a flame at a farthest end of a burner using a flame rectification rod. It comprises of a rod-element comprising of an inner electric-wire, an electrically insulating material surrounding the inner electric-wire, a metallic tubular outer rod protecting the insulating material and the inner electric-wire. The metallic tubular outer rod is electrically insulated from the inner electric-wire, and a flame rectification sensor is attached to the rod-element at the farthest end of the burner, which goes through the flame. The flame rectification sensor becomes exposed to a flame and sends a flame rectified signal to a controller, through the inner electric-wire.

9 Claims, 5 Drawing Sheets

REMOTE FLAME SENSING SYSTEM

FIELD OF THE INVENTION

The present invention relates generally to gas burner flame rectification, and especially to flame rectification (sensing) for pipe, ribbon, line, or other types of burners.

BACKGROUND OF THE INVENTION

In many parts of the world, including Canada and the United States, fuel safety Standards, Codes, Acts, etc. require that a burner with a flame space greater than a certain distance be sensed at the farthest point of the ignition. For example, in some jurisdictions, "when a burner has a flame width (or runs the length of a burner) in excess of 3 ft (900 mm) from the source of the burner ignition, (a) the main burner flame shall be proven at the farthest point(s) along its base from the source of ignition; (b) the source of ignition shall be located in the combustion zone adjacent to the entry of the fuel or fuel/air mixture to the burner; and (c) the main burner flame shall be proven at a location providing the most stable flame detection at all firing rates and not affected by the source of ignition." It is also required that line, pipe, ribbon, and radiant burners that are installed adjacent to one another or connected with flame-propagating devices, shall be considered to be a single burner and shall have at least one flame detector installed to sense burner flame at the end of the assembly farthest from the source of ignition.

One well known technique for detecting the presence of a flame is by using a flame rod, which works based on electrical properties associated with the flame. As a flame burns, it produces an ionized region in its vicinity, thereby providing an electrically conductive medium. This property can be utilized in conjunction with a probe placed into the flame, and a grounded metal burner to produce a usable electrical signal. If such apparatus is constructed with an effective grounded burner area greater than the effective probe area, typically in at least a 4 to 1 ratio, the flame will exhibit electrical characteristics somewhat similar to those of a diode in series with a 10 Mega-ohm resistor. If an alternating current signal is injected into the flame by the probe, the signal will be rectified by the flame. Appropriate filtering and amplification circuitry may then be employed to extract the rectified signal.

In the line, pipe, ribbon and radiant heaters, special flame rods are fabricated and fastened to the body of the burner. These rods run the length of the burner body, and at the end of the flame space the rods protrude into the flame. Flame rods can be fabricated into various lengths to suit the application.

Typically flame rods are made using a conductor, such as a high temperature alloy like Kanthal, Stainless Steel, and Inconel rod. The rod is usually surrounded by an insulator (ceramic, steatite etc.) to protect the rod from grounding. The principles of flame rectification require that flame sensing rod is to tell the controller that the main gas burners have ignited and a flame is present. If no flame is present after a certain amount of time, the controller needs to close the gas valves to the burners.

Typically, a burner or multiple burners are installed in a chamber and there is no direct access to the opposite end of the burner assembly. Thus, sensing the flame at the farthest point from ignition becomes very difficult. If a flame rod is mounted at the end of a burner, service and maintenance become very difficult.

The problem is that most currently available devices are not reliable for numerous reasons. They use a stainless steel, Kanthol or Inconel rods that run the length of the burner. Along the way the rod has several ceramic insulators that are fastened to brackets that allow the rod to remain fixed. At the end of the rod a portion is positioned into the flame. These ceramic insulators often move or crack, and as a result, the flame rod grounds and can no longer send an electrical signal to the burner flame safeguard. In addition, depending on who makes the assembly, some providers add extra steel over the area of the flame. This is in hopes that by providing a greater surface area over the flame it will sense better. Often, during operation as the steels expands when heated, it can touch the burner surface, causing it to ground out and not sense the flame. In this case, it will not re-ignite as the flame relay will not hold open, as when it is grounded the flame cannot sense during the trial for ignition period. In order to fix a failed flame rod, the burner needs to be removed from the chamber and a new assembly be installed, in the hopes that when reinstalled it will work. If not, the burner needs to be removed and process repeated.

Most manufacturers of such components are always pushing the envelope with the design of flame rods and only try to reduce the amount of ceramic (insulators) used. In addition, developers look for more robust materials or alloys that can handle exposure to high temperatures.

SUMMARY OF THE INVENTION

The present invention replaces the flimsy and problematic flame rod, with an insulated electric element to provide a robust and reliable flame sensor. The present flame sensing element can be extended along a long length of any burner without any grounding problem. Therefore, it is ideal for use in pipe, line, ribbon, infrared and tube burners that require to have a flame sensor at the opposite or farthest end from the burner's point of ignition.

One object of the present invention is to provide a sensor to sense flames at the farthest distance from the ignition point in various burners.

Another object of the present invention is to provide a remote sensing rod that solves the issue of flame rods, related to their material being consumable and after a short time will no longer sense a flame.

Another object of the present invention is to replace the currently used flame rods, which are flimsy stainless steel rods, which will be damaged over time, with a more robust systems.

Another object of the present invention is to reduce or rid the reliance on ceramic insulators as part of the flame sensing apparatus.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

The figures are not intended to be exhaustive or to limit the present invention to the precise form disclosed. It should be understood that the invention can be practiced with modification and alteration, and that the disclosed technology be limited only by the claims and equivalents thereof.

DETAILED DESCRIPTION OF PREFERRED EMBODIMENTS

The device disclosed herein, in accordance with one or more various embodiments, is described in detail with reference to the following figures. The drawings are provided for purposes of illustration only and merely depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

Figure 1:
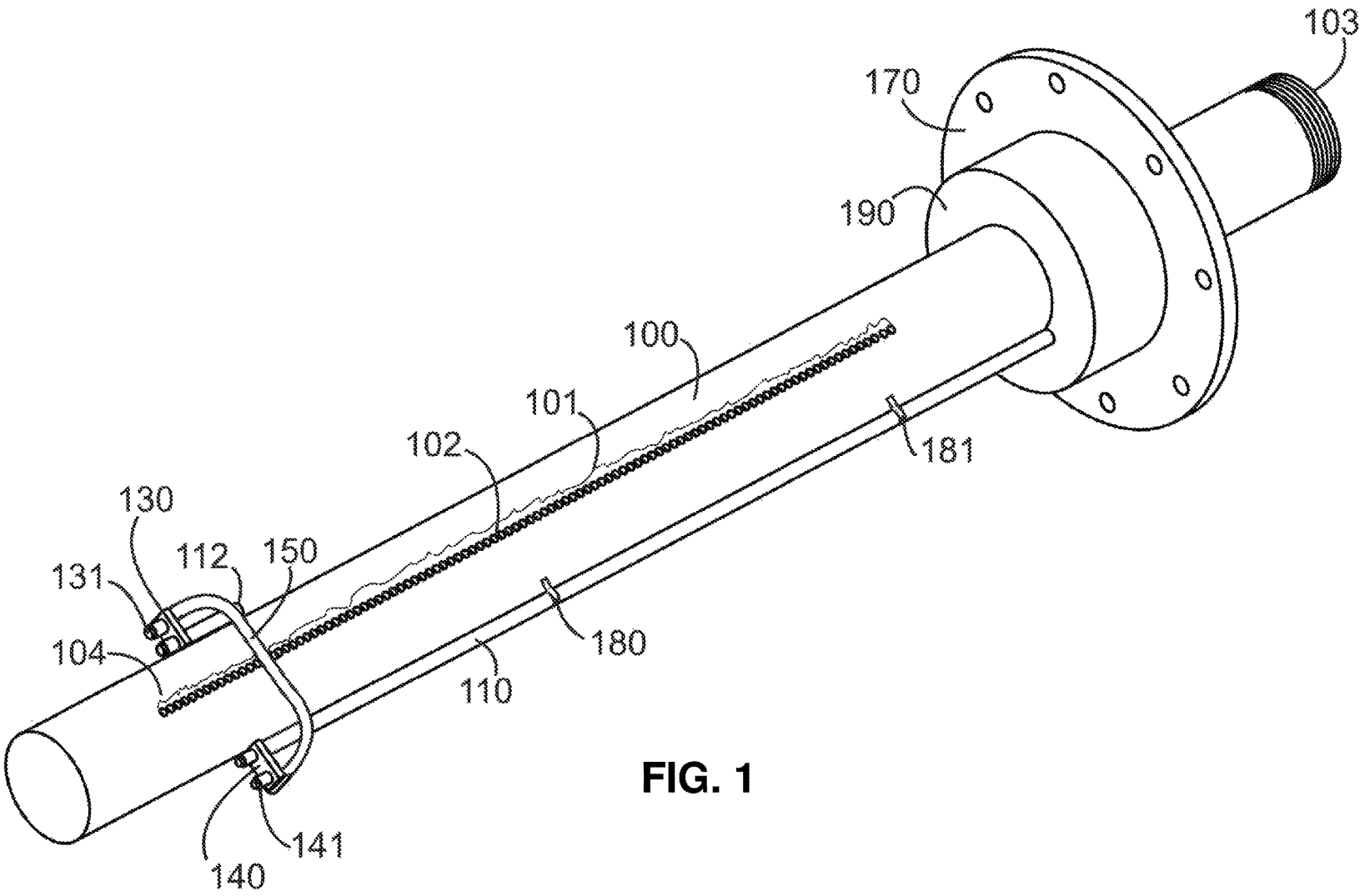
FIG. 1 illustrates a first embodiment of the present flame detector installed on a burner.

The remote flame sensing device of the present invention is illustrated in FIG. 1. A pipe burner 100 has a longitudinally extending flame 101, which is produced by passing a gas through a series of small orifices 102 (e.g., stamped ribbons pressed or held together to create a series of small orifices) and ignited to generate a stable flame on the pipe or ribbon burners. The gas enters into the pipe burner at the proximal end 103 of the pipe. It is required that the flame be detected on the distal end 104 of the pipe.

Figure 2A:
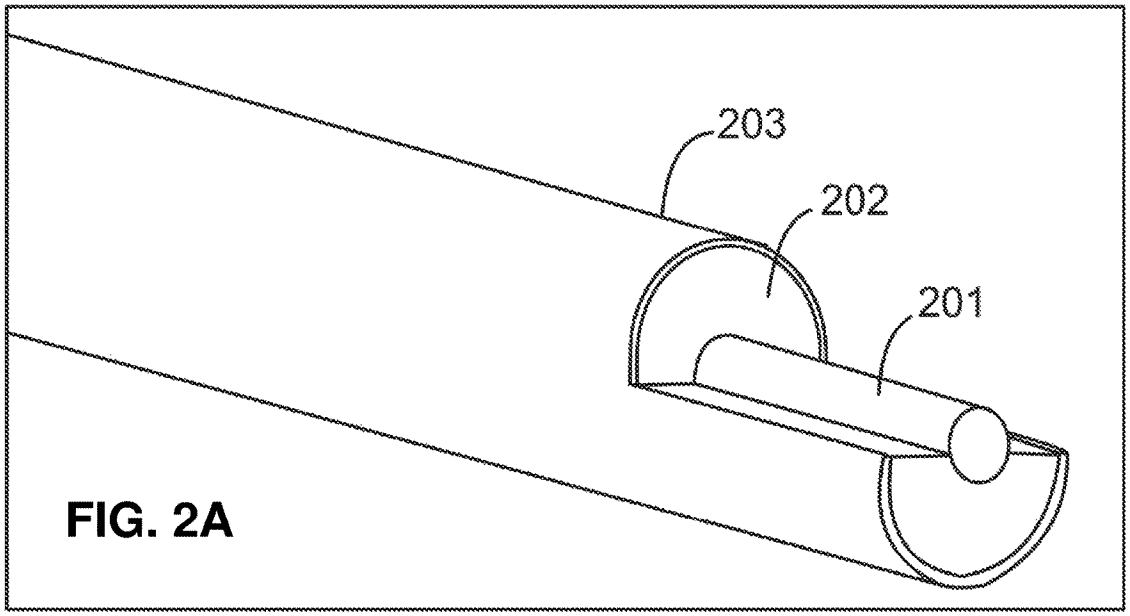
FIG. 2A illustrates the internal structure of the present rod element for flame detection.
Figure 2B:
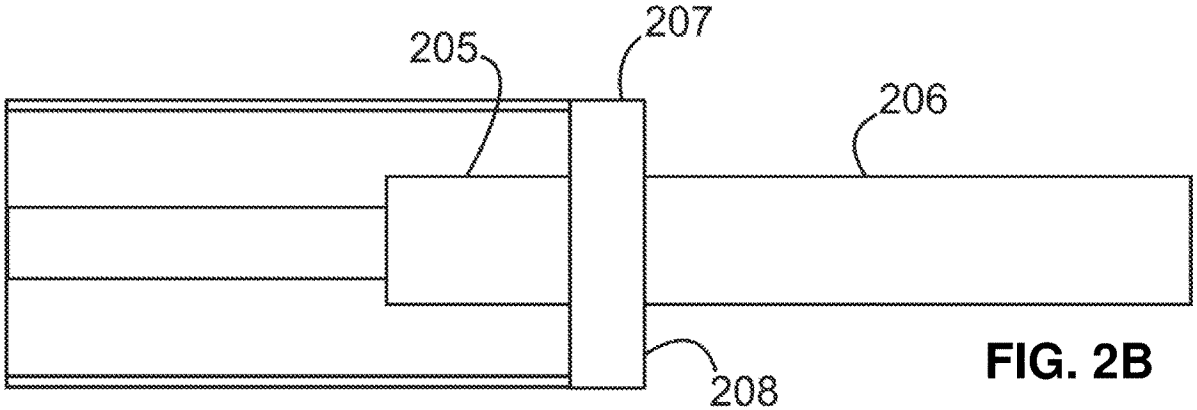
FIG. 2B illustrates the cold pin and the internal structure of the present rod element for flame detection.

The preferred embodiment of the present flame sensing device comprises of a rod-element 110, which extends from the proximal end 103 of the burner towards the distant 104 of the burner. The structure of the rod-element 110 is illustrated in FIG. 2A, and it comprises of an inner nichrome wire 201 insulated in magnesium oxide insulation 202, and fitted inside a tubular rod 203, preferably made from 304 stainless steel Sheath. The rod-element can be of any size and length, but preferably has a diameter of 0.375 inches. The rod diameter may be larger for longer burners to increase flame rectification and to compensate for loss in signal strength for longer burners. The rod-element can be mica insulated for higher temperature protection. It has a nickel plated cold pin 205 (see FIG. 2B) running the length of the element with terminal extensions 206 with ceramic insulators 207. The insulation material prevents electrical contact to the ground and improves the safety features of the element. The cold pin section 205 near each end 208 extends outside a chamber (e.g., a furnace) to connect to other electrical systems. The insulating martial prevents any contact of the wire with the sheath, preventing possible grounding.

The outer rod can also be from other high temperature metal alloys such as Incoloy 800 or Inconel 601. The outer sheath can withstand prolonged operation at high temperatures.

In one embodiment of the present invention, as illustrated in FIG. 1, the rod element 110 is attached to a separate flame sensor 150, which is installed close to the distal end 104 of the pipe burner. The flame sensor 150 is a piece of Kanthal rod or a section of rod element, which is rigidly positioned across the flame 101. The rod is typically 6" in length, but can be any size depending on the diameter of the pipe burner. Kanthal is the trademark for a family of iron-chromium-aluminium (FeCrAl) alloys used in a wide range of resistance and high-temperature applications. Kanthal FeCrAl alloys consist of mainly iron, chromium (20-30%) and aluminium (4-7.5%).

Two brackets, 130 and 140, rigidly hold the flame sensor and the rod-element, where the two are attached to each other. Therefore, the sensor 150 is connected to a main controller through the rod-element 110, which is attached to the burner body (on the sides of the pipe) 100 by a set of brackets 180, 181.

A long rod-element 110 is attached to one end 141 of the flame detector 150, extending from the distal end of the burner to the proximal end of the burner. In addition, a shorter rod-element 112 is connected to the second end 131 of the flame detector 150 to firmly hold the flame detector. The length of the rod-element depends on the burner length, and it can be any length. More commonly used lengths are 42", 48", 60", 72" and 144". The outer diameter is preferably 0.246".

Figure 3:
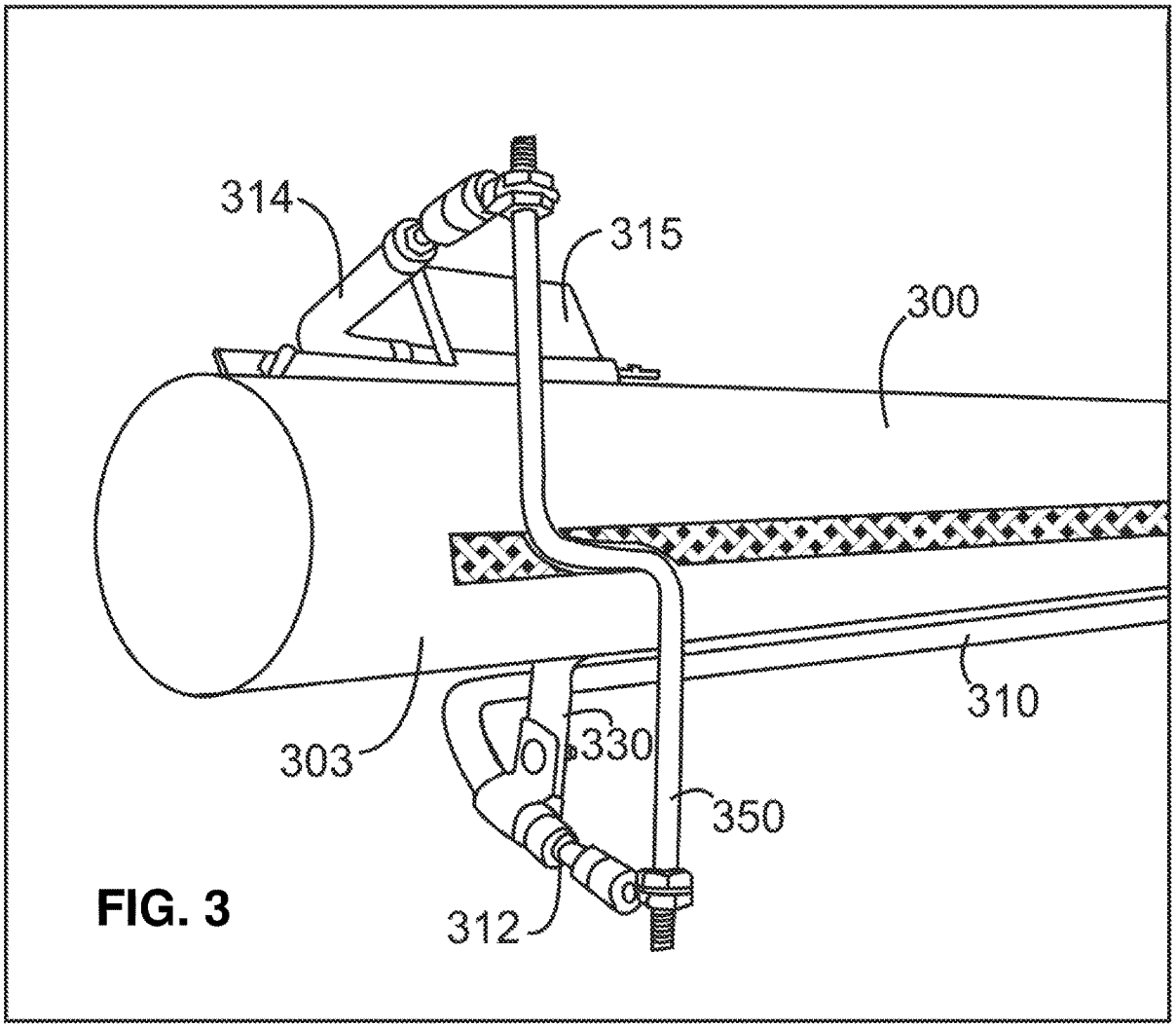
FIG. 3 illustrates a second embodiment of the present flame detector.

In another embodiment of the same invention, as illustrated in FIG. 3, the rod element 310 extends from the proximal end to the distal end of the burner 300, and it is fixed to the distal end of the burner though a bracket 330. The distal terminal end of the rod element 312 is attached to a flame sensor 350. The flame sensor is a Kanthal rod that may be straight or may be bent to extend over a longitudinal length of the burner, thus being exposed to a larger flame zone. This will increase the rectification effect and provide a better flame signal. In order to rigidly hold the flame sensor rod, it is connected to another short piece of rod 314, preferably of the same material as the rod element. The shorter rod element 314 is attached to the burner body 300 with another bracket 315.

Figure 4:
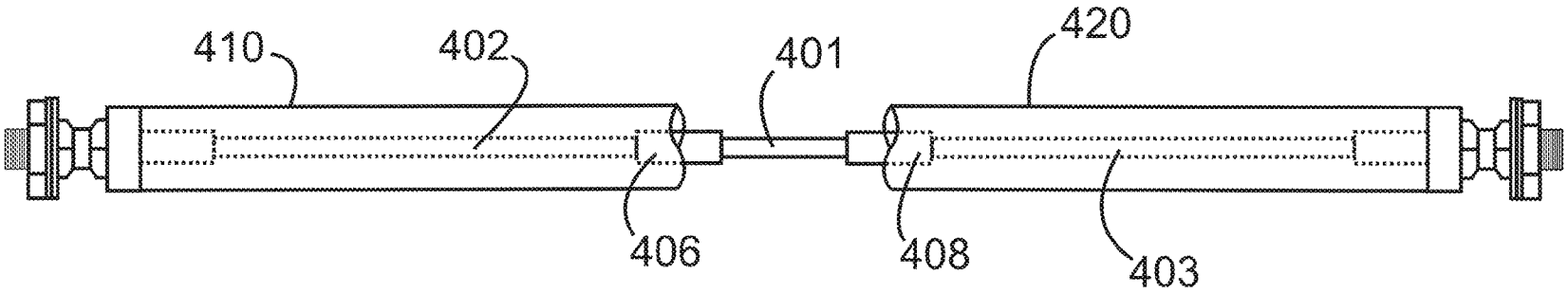
FIG. 4 illustrates a third embodiment of the present flame detector.

In another embodiment of the same invention, flame sensor is an integral part of the rod element, as illustrated in FIG. 4. In this embodiment, the rod element has an exposed section 401, in which a flame rod is exposed to the flame. Since the inner wire of the rod element 402 and 403 is made of Nichrome wire, which cannot withstand flame temperature, the wire, in the exposed section 401, is replaced with a section of Kanthal. In order to do this, the cold pin 406 at one end of the first section 410 of the rod element 402, is replaced with kanthal. The kanthal is extended out of the rod element and is exposed for a predefined length 401 and it then enters into a second rod element 420 and connected to the inner wire 403 at the second cold pin 408.

Figure 5A:
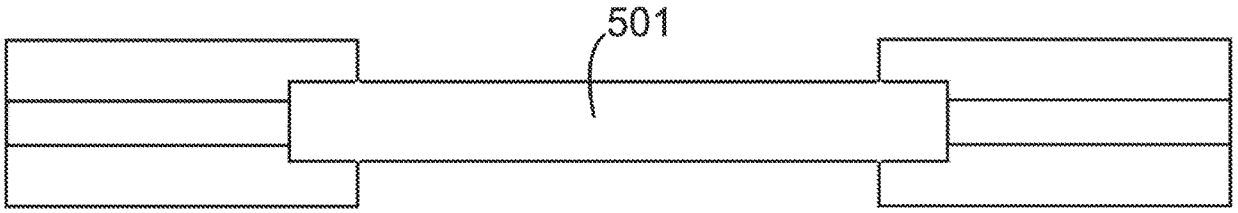
FIG. 5A illustrates a straight flame sensor of the third embodiment of the present flame detector.
Figure 5B:
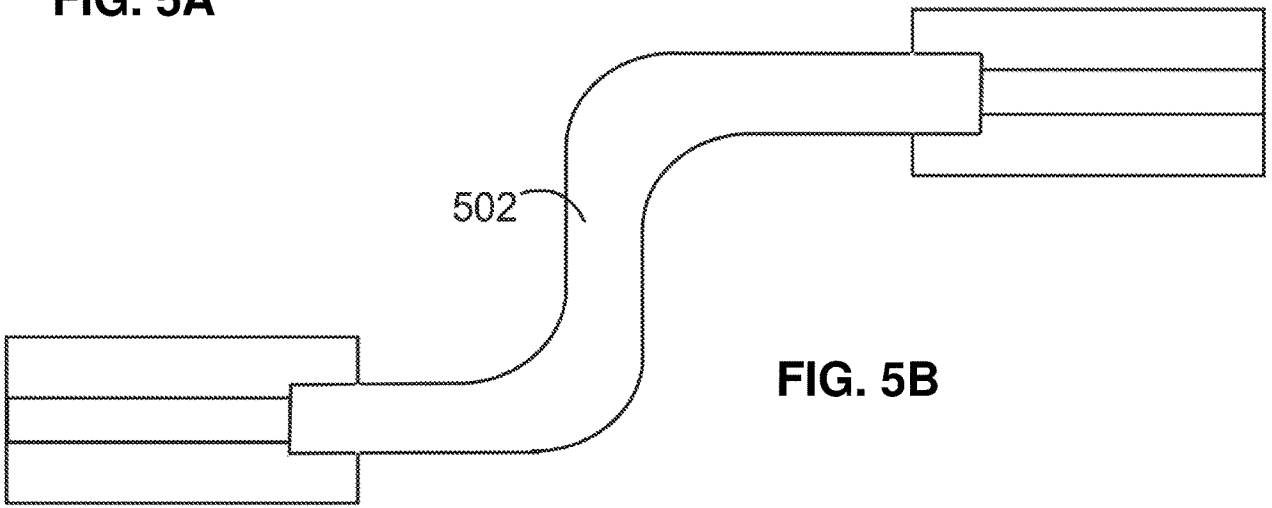
FIG. 5B illustrates a bent flame sensor of the third embodiment of the present flame detector.
Figure 5C:
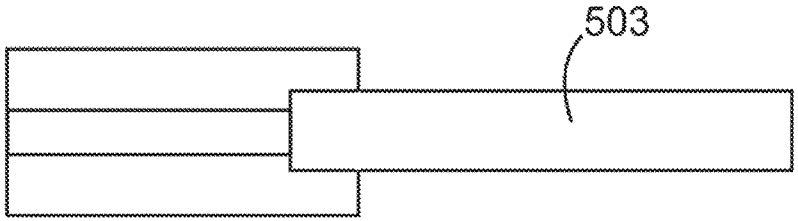
FIG. 5C illustrates a cantilever flame sensor.

As illustrated in FIGS. 5A and 5B, the exposed section 405 of the rod element may have different configurations. It can be a straight section 501 as illustrated in FIG. 5A, or can be a bent section 502 to have a longer flame exposure length, as illustrated in FIG. 5B. The exposed section can also be like a cantilever beam 503, extending out with a free end, as illustrated in FIG. 5C. In this embodiment, the rod-element only has one section.

In operation, a controller applies alternating voltage between the flame sensing rod and the base of the flame (ground). The ions in the flame provide a high resistance current path between the two. Because the surface of the base flame is larger than the sensing flame rod, more electrons flow in one direction than the other, resulting in a very small DC offset current. If there is a flame present, the DC offset is detected by the controller, which tells the gas valve to remain open. If there is no current flow, the controller will close the gas valve and the system will purge itself of any remnant gas before trying to reignite or lockout.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A burner flame detector for a burner having a burner-length, a burner-proximal end and a burner-distal end, said detector comprising:

a) a long rod-element comprising of an inner electric-wire, an electrically insulating material surrounding said inner electric-wire, a metallic tubular outer rod protecting said insulating material and said inner electric-wire, wherein said rod-element runs from said burner-distal end to said burner-proximal end along the burner-length, and wherein said metallic tubular outer rod is electrically insulated from said inner electric-wire;

b) a first cold pin section connected to a first end of said inner electric-wire, wherein said first cold pin section connects to an external circuit;

c) a second cold pin section connected to a second end of said inner electric-wire;

d) a flame rectification sensor connecting said second-cold-pin to a third-cold-pin, wherein said flame rectification sensor becomes exposed to a flame of said burner to detect the flame and to send a flame rectified signal to a controller, wherein said inner electric-wire carries an alternating current power source and returns a rectified signal to detect the flame, and e) a short rod-element connected to the third-cold-pin from one end and to the burner from the other end to rigidly hold the flame rectification sensor.

2. A burner flame detector for a burner having a burner-length, a burner-proximal end and a burner-distal end, said detector comprising:

a) a rod-element comprising of an inner electric-wire, an electrically insulating material surrounding said inner electric-wire, a metallic tubular outer rod protecting said insulating material and said inner electric-wire, wherein said rod-element runs from said burner-distal end to said burner-proximal end along the burner-length, and wherein said metallic tubular outer rod is electrically insulated from said inner electric-wire;

b) a first cold-pin to connect a first end of said inner electric-wire to an external circuit, and c) a flame rectification sensor attached to a second end of said inner electric-wire at said burner-distal end, wherein said flame rectification sensor extends out of said rod-element as a cantilever beam and becomes exposed to a flame of said burner to detect the flame and to send a flame rectified signal to a controller, wherein said inner electric-wire carries an alternating current power source and returns a rectified signal to detect the flame.

3. The burner flame detector of claims 1 and 2, wherein said inner electric-wire is made of Nichrome.

4. The burner flame detector of claims 1 and 2, wherein said insulating material is made of magnesium oxide.

5. The burner flame detector of claims 1 and 2, wherein said metallic tubular rod is made of any one of 304 Stainless Steel or Incoloy 800 or Inconel 601.

6. The burner flame detector of claims 1 and 2, wherein said metallic tubular rod is mica insulated for higher temperature protection.

7. The burner flame detector of claim 1, has a nickel plated cold pin with terminal extensions and ceramic insulators extending along the length of the rod element to connect to any other electrical systems.

8. The burner flame detector of claim 1, wherein said flame rectification sensor is a straight or a bent piece of iron-chromium-aluminium (FeCrAl) alloys.

9. The burner flame detector of claims 1 and 2, further having an electrical supply line connected to the first end of the rod element to provide an alternating voltage as powering energy.

* * * * *